US011560612B2

(12) United States Patent
Ferrer et al.

(10) Patent No.: US 11,560,612 B2
(45) Date of Patent: Jan. 24, 2023

(54) METHOD FOR PRODUCING A LOW-ALLOY STEEL INGOT

(71) Applicants: SAFRAN AIRCRAFT ENGINES, Paris (FR); SAFRAN LANDING SYSTEMS, Velizy-Villacoublay (FR)

(72) Inventors: Laurent Ferrer, Moissy-Cramayel (FR); Nicolas Binot, Araux (FR)

(73) Assignees: SAFRAN AIRCRAFT ENGINES, Paris (FR); SAFRAN LANDING SYSTEMS, Velizy-Villacoublay (FR)

( * ) Notice: Subject to any disclaimer, the term of this patent is extended or adjusted under 35 U.S.C. 154(b) by 706 days.

(21) Appl. No.: 16/450,219

(22) Filed: Jun. 24, 2019

(65) Prior Publication Data

US 2019/0309390 A1 Oct. 10, 2019

Related U.S. Application Data

(62) Division of application No. 15/317,508, filed as application No. PCT/EP2015/062406 on Jun. 3, 2015, now Pat. No. 10,364,479.

(30) Foreign Application Priority Data

Jun. 10, 2014 (FR) ..... 1455202

(51) Int. Cl.
*C22C 38/44* (2006.01)
*C22B 9/04* (2006.01)
(Continued)

(52) U.S. Cl.
CPC ..... *C22C 38/44* (2013.01); *B22D 27/02* (2013.01); *B22D 27/04* (2013.01); *C22B 9/04* (2013.01);
(Continued)

(58) Field of Classification Search
CPC ..... C22C 38/00; C22C 38/02; C22C 38/04; C22C 38/44; C22C 38/46; B22D 27/02;
(Continued)

(56) References Cited

U.S. PATENT DOCUMENTS 5,415,834 A * 5/1995 Finkl ..... C22C 38/46 148/335
5,884,685 A * 3/1999 Umezawa ..... B22D 11/16 164/451
7,597,737 B2 * 10/2009 Hara ..... C22C 38/14 75/10.64

FOREIGN PATENT DOCUMENTS

CN 101568662 A 10/2009
CN 102605274 A 7/2012
(Continued)

OTHER PUBLICATIONS

ASTM E45-10 Standard Test Methods for Determining the Inclusion Content of Steel Published Dec. 2010. (Year: 2010).*
(Continued)

*Primary Examiner* — Alexandra M Moore
(74) *Attorney, Agent, or Firm* — Pillsbury Winthrop Shaw Pittman LLP

(57) ABSTRACT

A method of fabricating a low alloy steel ingot, the method including a) melting all or part of an electrode by a vacuum arc remelting method, the electrode, before melting, including iron and carbon, the melted portion of the electrode being collected in a crucible, thus forming a melt pool within the crucible; and b) solidifying the melt pool by heat exchange between the melt pool and a cooling fluid, the heat exchange applied serving to impose a mean solidification speed during step b) that is less than or equal to 45 μm/s and to obtain an ingot of low alloy steel.

6 Claims, 2 Drawing Sheets

(51) Int. Cl.

| | |
|---|---|
| ***C22B 9/20*** | (2006.01) |
| ***B22D 27/02*** | (2006.01) |
| ***B22D 27/04*** | (2006.01) |
| ***C22C 38/00*** | (2006.01) |
| ***C22C 38/02*** | (2006.01) |
| ***C22C 38/04*** | (2006.01) |
| ***C22C 38/46*** | (2006.01) |

(52) U.S. Cl.
CPC ..... *C22B 9/20* (2013.01); *C22C 38/00* (2013.01); *C22C 38/02* (2013.01); *C22C 38/04* (2013.01); *C22C 38/46* (2013.01)

(58) Field of Classification Search
CPC .. B22D 27/04; C22B 9/04; C22B 9/20; F27B 3/28; F27D 19/00
See application file for complete search history.

(56) References Cited

FOREIGN PATENT DOCUMENTS

| | | | |
|---|---|---|---|
| EP | 1 679 384 | A1 | 7/2006 |
| JP | H07-238344 | A | 9/1995 |
| JP | H11-256264 | A | 9/1999 |
| JP | 2001-329339 | A | 11/2001 |
| JP | 2001-335880 | A | 12/2001 |
| JP | 3708376 | B2 | 10/2005 |
| JP | 2008-272790 | A | 11/2008 |
| KR | 10-1302693 | B1 | 9/2013 |
| WO | WO 2008/015258 | A1 | 2/2008 |

OTHER PUBLICATIONS

Williamson et al. "Modern Control Strategies for Vacuum Arc Remelting of Segregation Sensitive Alloys". Superalloys 718, 625, 706 and Various Derivatives. The Minerals, Metals & Materials Society. (Year: 1997).‡

International Search Report as issued in International Patent Application No. PCT/EP2015/062406, dated Nov. 10, 2015.

Hans, S., et al., "Industrial Applications of VAR Modelling for Special Steels and Nickel-based Superalloys," Proceedings of the 2005 International Symposium on Liquid Metal Processing and Casting, vol. 2005, Jan. 2005, XP009181470, ISBN: 978-0-87170-827-4, 8 pages.

Jardy, A., "Mathematical modelling of the vacuum arc remelting process," Revue de Metallurgie—Cahiers d'Informations Techniques, vol. 100, No. 6, Jun. 2003, XP001177251, ISSN: 0035-1563, pp. 595-605.

Quatravaux, T., et al., "Transient VAR ingot growth modelling: application to specialty steels," Proceedings of the 2003 International Symposium on Liquid Metals, Journal of Materials Science, vol. 39, No. 24, Dec. 2004, XP019210070, ISSN: 1573-4803, pp. 7183-7191.

Chapelle, P., et al., "Effect of electromagnetic stirring on melt pool free surface dynamics during vacuum arc remelting," Journal of Materials Science, vol. 43, No. 17, Aug. 2008, XP019607700, ISSN: 1573-4803, pp. 5734-5746.

Mitchell, A., "Solidification in remelting processes," Materials Science and Engineering A: Structural Materials: Properties, Microstructure & Processing, vol. 413-414, Dec. 2005, XP027791448, ISSN: 0921-5093, pp. 10-18.

Notice of Rejection as issued in Japanese Patent Application No. 2017-517188, dated May 14, 2019.

Williamson et al. "Modern Control Strategies for Vacuum Arc Remelting of Segregation Sensitive Alloys". Superalloys 718, 625, 706 and Various Derivatives. The Minerals, Metals & Materials Society. (Year: 1997).

Marcomini, J. B., et al., "Characterization of a New Fe—C—Mn—Si—Cr Bearing Alloy: Tempered Martensite Embrittlement Susceptibility." © ASM International, Journal of Materials Engineering and Performance, vol. 23(3), Mar. 2014, pp. 780-785.

Tartaglia, J. M., et al. "A Comparison of Mechanical Properties and Hydrogen Embrittlement Resistance of Austempered vs Quenched and Tempered 4340 Steel," Metallurgical and Materials Transactions A, vol. 39A, Mar. 2008, pp. 559-576.

Wang, X., et al., "Control of Stringer Shaped Non-Metallic Inclusions of CaO—$Al_2O_3$ System in API X80 Linepipe Steel Plates," steel research int., vol. 85, No. 2, (2014), pp. 155-163.

Sandor, L. T., et al., "Fatigue Crack Propagation in Nine Steels, Type SAE 43XX, from 0.20 to 1.00%C, for the Simulation of the Fatigue Behavior in a Carburized Layer of the SAE 4320," Procedia Engineering, vol. 2, (2010), pp. 735-742.

* cited by examiner
‡ imported from a related application

METHOD FOR PRODUCING A LOW-ALLOY STEEL INGOT

CROSS-REFERENCE TO RELATED APPLICATIONS

This is a divisional of U.S. application Ser. No. 15/317,508, filed on Dec. 9, 2016, which is the U.S. National Stage of PCT/EP2015/062406, filed Jun. 3, 2015, which in turn claims priority to French Patent Application No. 1455202, filed Jun. 10, 2014, the entire contents of all applications are incorporated herein by reference in their entireties.

BACKGROUND OF THE INVENTION

The invention relates to methods of fabricating low alloy steel ingots and to steel parts that can be obtained by such methods.

When making high integrity mechanical parts that are subjected to high levels of alternating stresses, it can be necessary to design them by using minimum curves covering all of the results characterizing the looked-for properties, including fatigue strength properties. Unfortunately, minimum design curves depend not only on the mean value but also on the dispersion of results. This is particularly true for parts that are used in aviation for which statistical analysis is generally taken into account. Reducing the dispersion of results thus makes it possible to raise the minimum design curves and consequently to improve the performance of parts, e.g. by enabling them to be lighter in weight, to have a longer lifetime, or to increase the stresses to which they may be exposed. Reducing the dispersion of results advantageously makes it possible to obtain a competitive technical difference and economic savings in terms of material used.

Lifetime during oligo-cyclic fatigue stresses may depend firstly on the energy consumed at the moment of initiation on one of the particles present in the metal material that leads to microcracking, and secondly on the propagation of the crack.

Because of a lack of accommodation, certain particles may be subjected to premature cracking, reducing initiation energy, and consequently reducing lifetime compared with the matrix on its own. The nature of the particle, its shape, its individual size, its spatial distribution, and its tendency to cluster with other particles can all have a direct influence on reducing this initialization energy. Dispersion in the types of flaw can lead to wide dispersion in reductions of initiation energy and can consequently correspondingly lower even farther the curve covering the minimum points (by lowering the mean and increasing the standard deviation).

This can apply in particular for steels, and more particularly for remelted low alloy steels. It is known to fabricate grades of steel by remelting metal in an evacuated electric arc furnace (using a vacuum arc remelting method). Such a step serves to improve the inclusion cleanliness by filtering out certain particles that were already present in the metal before such remelting.

With low alloy steels, the presence of included particles of the sulfide and/or oxide type, whether isolated, agglomerated, or in alignment can have an influence on oligo-cyclic fatigue lifetimes. The operations prior to remelting that are presently performed seek to minimize the probability of such particles being present.

Nevertheless, there can remain both particles that are exogenous, and particles that reform during cooling as a result of poor solubility.

In addition, it can be desirable to implement the most stable possible remelting method in order to cause rafts of oxides and sulfides to float in regular manner at the surface of the liquid, going from the center towards the edge of the crucible in the furnace. Nevertheless, each remelting furnace presents a certain amount of dispersion, thereby giving rise to dispersion in the sizes of these flaws, and consequently giving rise to disparities in the lifetimes of the products that are obtained.

There exists a need to be able to obtain low alloy steel parts that present improved lifetimes.

There exists a need to obtain low alloy steel parts that present disparities that are smaller in terms of mechanical properties.

There exists a need to obtain methods of fabricating low alloy steel that make it possible to reduce the impact of instabilities of the remelting furnace.

There also exists a need to have new methods of fabricating parts made of low alloy steel.

OBJECT AND SUMMARY OF THE INVENTION

To this end, in a first aspect, the invention provides a method of fabricating a low alloy steel ingot, the method comprising the following steps:

a) melting all or part of an electrode by a vacuum arc remelting method, the electrode, before melting, comprising iron and carbon, the melted portion of the electrode being collected in a crucible, thus forming a melt pool within the crucible; and b) solidifying the melt pool by heat exchange between the melt pool and a cooling fluid, the heat exchange applied serving to impose a mean solidification speed during step b) that is less than or equal to 45 micrometers per second (μm/s) and to obtain an ingot of low alloy steel.

The term "low alloy steel" should be understood as meaning a steel in which no alloying element is present at a content by weight greater than 5.00%. In other words, in a low alloy steel, each of the chemical elements, other than iron, is present at a content by weight that is less than or equal to 5.00%.

In the meaning of the invention, the term "melt pool" means the liquid portion obtained after melting the electrode together with the pasty portion situated between the liquid portion and the resulting ingot.

The term "mean solidification speed during step b)" is used to mean the ratio of the distance traveled by the solidification front during step b) divided by the duration of step b). The solidification front corresponds to the boundary between the resulting ingot and the pasty zone of the melt pool. The distance traveled by the solidification front is equal to the distance measured along the longitudinal axis of the crucible as traveled by the bottom of the melt pool (i.e. by the point of the melt pool that is closest to the bottom of the crucible and that is situated in contact with the solidification front). The duration of step b) is the duration during which the melt pool is being solidified.

The invention advantageously makes it possible to obtain low alloy steel ingots that present inclusions of reduced size and alignment.

The invention advantageously makes it possible to obtain low alloy steel ingots presenting a dispersion in the population of inclusions obtained during fabrication that is smaller in comparison with ingots fabricated by prior art methods.

The ingots obtained by the method of the invention advantageously present mechanical properties and lifetimes that are improved compared with ingots fabricated by known methods.

In the invention, a solidification speed for the melt pool is imposed that is low enough for all or some of the inclusions present in the melt pool to "rise" to the surface of the melt pool faster than does the solidification front. Thus, in the invention, the mean solidification speed is selected so as to be less than the floating speed of some or all of the inclusions present in the melt pool (i.e. the speed at which they rise to the surface of the melt pool). As a result, the invention advantageously enables the inclusions to float as a raft at the surface of the melt pool and prevents them from becoming trapped within the resulting ingot.

The mechanism whereby inclusions float or are decanted within the melt pool can be described by using Navier-Stokes equations. For example, the floating speed vf of the inclusions is given by the following equation:

$$vf=K\cdot r^2\cdot\Delta(\rho) \quad (1)$$

where K is a physical constant describing the acceleration constant due to gravity and the dynamic viscosity at a given temperature, r is the radius of the inclusion, and $\Delta(\rho)$ is the difference between the density of the inclusion and the density of the melt pool.

Equation (1) shows that small inclusions take longer to rise to the surface than large inclusions in proportion to their radius squared. Furthermore, equation (1) shows that an increase in the density difference increases the floating speed.

The time required for an inclusion to float $t_{float}$, corresponding to the time necessary for an inclusion to rise to the surface of the melt pool, can be estimated using the following equation:

$$t_{float}=\Delta D/vf \quad (2)$$

where $\Delta D$ is the increase in distance from the bottom of the crucible as measured along the longitudinal axis of the crucible between the initial position of the inclusion and the position where the inclusion is situated at the surface of the melt pool.

Because of the way the solidification speed is controlled during step b), the float time for all or some of the inclusions present in the melt pool is less than the duration of step b).

In an implementation, the mean solidification speed imposed during step b) may advantageously be less than the float speed of all or some of the non-metallic inclusions present in the melt pool.

The mean solidification speed imposed during step b) may advantageously be less than the float speed of inclusions that are present in the melt pool and that are suitable for crystallizing in the melt pool but not in the resulting ingot. In particular, the mean solidification speed imposed during step b) may advantageously be less than the float speed of aluminas $Al_2O_3$ and/or than the float speed of lime aluminas of formula $[(Al_2O_3)_x(CaO)_y]$ present in the melt pool.

For alumina or lime alumina inclusions of similar densities, the float speeds and consequently the float times can be similar. For inclusion radii of 2 micrometers (μm), floating durations may for example be less than 60 minutes (min).

Thus, by way of example, the duration of step b) may be greater than or equal to 60 min, e.g. 100 min.

In an implementation, after step b), the method of the invention may also include a homogenizing step c) for homogenizing alloy elements present in the resulting ingot. By way of example, step c) may comprise subjecting the resulting ingot to heat treatment at a temperature lower than its melting temperature.

Such a step is advantageous insofar as it enables alloy elements to diffuse from regions having higher contents of alloy elements towards regions having lower contents of alloy elements.

In an implementation, after step c), the method of the invention may also include a shaping step d) in which the ingot is shaped while hot. Step d) may serve to obtain a semi-finished product from the ingot, e.g. in the form of a bar or a sheet.

The mean solidification speed imposed during step b) may preferably be less than or equal to 40 μm/s, preferably less than 35 μm/s, preferably less than 30 μm/s, and more particularly preferably less than 25 μm/s.

It is particularly advantageous to impose such mean solidification speeds during step b). Specifically, in the vacuum arc remelting method, the remelting furnace may present instabilities that can lead to rafts of inclusions being sent back to the bottom of the melt pool. The presence of such instabilities can lead to an increase in the length of time needed for those inclusions to rise to the surface of the melt pool and stay there. Operating at such mean solidification speeds makes it possible advantageously to further increase the difference between the time required for solidifying the melt pool and the time required for an inclusion to rise to the surface. Consequently, the negative impact of instabilities of the remelt furnace is advantageously reduced since solidification is slower, thus leaving any inclusions that might have been sent back to the bottom of the melt pool enough time to rise to the surface.

Thus, the float time for all or some of the inclusions present in the melt pool may advantageously be less than or equal to two-thirds or indeed half of the duration of step b).

By way of example, the diameter of the electrode before melting may lie in the range 650 millimeters (mm) to 1200 mm.

The term "diameter of the electrode" should be understood as the largest dimension of the electrode measured perpendicularly to the longitudinal axis of the electrode.

Preferably, before melting, the electrode may be cylindrical in shape.

The use of a cylindrical electrode advantageously makes it possible, after melting, to obtain rising movement of the inclusions within the melt pool that takes place essentially along the longitudinal axis of the crucible. This serves advantageously to further limit the quantity of inclusions that become trapped in the resulting ingot after solidification since inclusions rise more directly to the surface of the melt pool.

The invention is not limited to using an electrode that is cylindrical in shape before melting. Specifically, in a variant, before melting, the electrode may be in the shape of a cone or of a rectangular parallelepiped.

By way of example, in an implementation, the diameter of the melt pool may lie in the range 650 mm to 1200 mm. The diameter of the melt pool may also lie in the range 700 mm to 950 mm. The diameter of the melt pool may also lie in the range 650 mm to 950 mm. The diameter of the melt pool may also lie in the range 700 mm to 1200 mm.

Unless specified to the contrary, the diameter of the melt pool corresponds to its greatest dimension measured perpendicularly to the longitudinal axis of the crucible. For example, for a crucible of cylindrical shape, the diameter of the melt pool is measured perpendicularly to the height of the cylinder. The diameter of the melt pool is measured without taking account to the thickness of the side wall of the crucible.

Preferably, the mean solidification speed imposed during step b) may be greater than or equal to 9 μm/s, and more preferably greater than or equal to 14 μm/s.

The use of such values for the solidification speed is advantageous since they make it possible to obtain particularly few solidification microsegregations during step b). This makes it possible advantageously to further improve the mechanical properties of the resulting ingot, such as its toughness or the extent to which its static mechanical properties are isotropic.

Furthermore, the greater the number of microsegregations that are included in the ingot, the longer the potential duration of the homogenizing step c).

Consequently, using such solidification speed values also serves advantageously to obtain better industrial efficiency for the method, e.g. by avoiding the need to have homogenizing durations longer than 200 hours (h), and indeed possibly avoiding any need to have homogenizing durations longer than 100 h.

The use of such solidification speeds thus advantageously serves to reduce the cost of the method and to improve its productivity.

The general knowledge of the person skilled in the art suffices to adapt the cooling that is performed so as to obtain the desired solidification speeds during step b).

By way of example, the cooling fluid may be a cooling liquid. In an implementation, it is possible during step b) to use in combination a cooling liquid and a cooling gas in order to perform the heat exchange. Under such circumstances, the cooling gas may be selected from: helium, argon, and nitrogen.

By way of example, the cooling liquid may be selected from: water, a polymer fluid, and molten sodium. The water used as a cooling fluid may possibly include additives such as water softeners or antibacterial agents.

By way of example, the cooling fluid may move relative to the crucible during all or part of step b). By way of example, the speed of circulation of the cooling fluid used for performing the heat exchange may be greater than or equal to 1000 liters per minute (L/min), preferably lying in the range 2000 L/min to 6000 L/min, during all or part of step b).

For example, before the beginning of the heat exchange, the cooling fluid may be at a temperature that is less than or equal to 80° C.

For example, the crucible may include, and in particular may consist of, a thermally-conductive metal. For example, the crucible may include, and in particular may consist of, copper or brass.

In an implementation, carbon may be present in the electrode before melting at a content by weight lying in the range 0.09% to 1.00%.

In an implementation, the electrode may also include, prior to melting, chromium at a content by weight lying in the range 0.10% to 5.50%.

In an implementation, the electrode may also include, prior to melting, molybdenum at a content by weight less than or equal to 5.00%, e.g. lying in the range 0.05% to 5.00%.

The use of these elements at such contents by weight advantageously confers satisfactory mechanical properties on the resulting ingot.

In an implementation, prior to melting, the electrode may comprise iron, together with:

- carbon at a content by weight lying in the range 0.09% to 1.00%;
- manganese at a content by weight less than or equal to 6.00%, e.g. lying in the range 0.010% to 6.00%;
- nickel at a content by weight less than or equal to 5.50%, e.g. lying in the range 0.010% to 5.50%;
- silicon at a content by weight less than or equal to 3.00%, e.g. lying in the range 0.010% to 3.00%;
- chromium at a content by weight lying in the range 0.10% to 5.50%;
- molybdenum at a content by weight less than or equal to 5.00%, e.g. lying in the range 0.05% to 5.00%;
- vanadium at a content by weight less than or equal to 5.00%, e.g. lying in the range 0.005% to 5.00%; and
- optionally one or more other alloying elements, the other alloying elements together being present at a content by weight that is less than or equal to 3.00%, e.g. lying in the range 0.010% to 3.00%.

In an implementation, prior to melting, the electrode may present the following composition:

- carbon at a content by weight lying in the range 0.09% to 1.00%;
- manganese at a content by weight less than or equal to 6.00%, e.g. lying in the range 0.010% to 6.00%;
- nickel at a content by weight less than or equal to 5.50%, e.g. lying in the range 0.010% to 5.50%;
- silicon at a content by weight less than or equal to 3.00%, e.g. lying in the range 0.010% to 3.00%;
- chromium at a content by weight lying in the range 0.10% to 5.50%;
- molybdenum at a content by weight less than or equal to 5.00%, e.g. lying in the range 0.05% to 5.00%;
- vanadium at a content by weight less than or equal to 5.00%, e.g. lying in the range 0.005% to 5.00%; and
- optionally one or more other alloying elements, the other alloying elements together being present at a content by weight that is less than or equal to 3.00%, e.g. lying in the range 0.010% to 3.00%; and
- the balance being iron to 100.00%.

The present invention also provides a part made of low alloy steel comprising iron and carbon, the part extending along a longitudinal axis, the part being such that when evaluated using the D method of the ASTM E 45-10 standard, the following results are obtained for analysis along the longitudinal axis:

- the number of fields including type D inclusions of severity level equal to 0.5 is less than 5;
- no field including type D inclusions of severity level equal to 1 is obtained; and
- no field including type B inclusions of severity level equal to 0.5 is obtained.

Unless specified to the contrary, both "thin" inclusions and "heavy" inclusions are counted.

Such a part of the invention advantageously presents fatigue strength that is improved relative to prior art parts. In addition, when a plurality of these parts is analyzed, it is found that the dispersion of the results that are obtained in terms of lifetime is smaller than the dispersion presented by a sample of parts produced by known methods.

The part may be obtained by performing a method as described above. The part may include non-metallic inclusions. The part may correspond to the ingot obtained at the end of above-described step b) or possibly at the end of above-described step c). The part may also correspond to a semi-finished product as obtained after performing above-described step d).

In an embodiment, when the part is evaluated using the method D of the ASTM E 45-10 standard, the following result may be obtained when summing the three measurement results obtained along the longitudinal axis of the part and along the two axes perpendicular to the longitudinal axis:

the total number of fields including type D inclusions of severity level equal to 0.5 is less than or equal to 15, preferably less than or equal to 10.

In an embodiment, carbon may be present at a content by weight lying in the range 0.09% to 1.00%.

In an embodiment, the part may also include chromium at a content by weight lying in the range 0.05% to 5.00%.

In an embodiment, the part may also include molybdenum at a content by weight less than or equal to 5.00%, e.g. in the range 0.05% to 5.00%.

In an embodiment, the part may comprise iron together with:

carbon at a content by weight lying in the range 0.09% to 1.00%;

manganese at a content by weight less than or equal to 5.00%, e.g. lying in the range 0.005% to 5.00%;

nickel at a content by weight less than or equal to 5.00%, e.g. lying in the range 0.010% to 5.00%;

silicon at a content by weight less than or equal to 3.00%, e.g. lying in the range 0.010% to 3.00%;

chromium at a content by weight lying in the range 0.05% to 5.00%;

molybdenum at a content by weight less than or equal to 5.00%, e.g. lying in the range 0.05% to 5.00%;

vanadium at a content by weight less than or equal to 5.00%, e.g. lying in the range 0.005% to 5.00%; and optionally one or more other alloying elements, the other alloying elements together being present at a content by weight less than or equal to 3.00%, e.g. lying in the range 0.010% to 3.00%.

In an embodiment, the part may present the following composition:

carbon at a content by weight lying in the range 0.09% to 1.00%;

manganese at a content by weight less than or equal to 5.00%, e.g. lying in the range 0.005% to 5.00%;

nickel at a content by weight less than or equal to 5.00%, e.g. lying in the range 0.010% to 5.00%;

silicon at a content by weight less than or equal to 3.00%, e.g. lying in the range 0.010% to 3.00%;

chromium at a content by weight lying in the range 0.05% to 5.00%;

molybdenum at a content by weight less than or equal to 5.00%, e.g. lying in the range 0.05% to 5.00%;

vanadium at a content by weight less than or equal to 5.00%, e.g. lying in the range 0.005% to 5.00%;

optionally one or more other alloying elements, the other alloying elements together being present at a content by weight less than or equal to 3.00%, e.g. lying in the range 0.010% to 3.00%; and the balance being iron to 100.00%.

By way of example, the part of the invention may have various alloying elements in the proportions specified in Table 1 given below.

TABLE 1

| | % C | % Mn | % Ni | % Si | % Cr | % Mo | % V |
|---|---|---|---|---|---|---|---|
| Part 1 | 0.13 | 0.2 | 3.4 | 0.2 | 4.1 | 4.3 | 1.2 |
| Part 2 | 0.15 | 0.5 | 3.2 | 0.3 | 1.0 | 0.3 | <0.1 |
| Part 3 | 0.20 | 0.5 | 3.2 | 0.3 | 1.0 | 0.3 | <0.1 |
| Part 4 | 0.32 | 0.7 | <0.4 | 0.3 | 3.3 | 2.0 | 0.3 |
| Part 5 | 0.35 | 0.5 | 3.9 | 0.3 | 1.8 | 0.4 | <0.1 |
| Part 6 | 0.40 | <0.5 | 1.8 | <0.5 | 0.8 | 0.3 | <0.1 |
| Part 7 | 0.40 | 0.5 | <0.4 | 0.2 | 3.2 | 1.0 | 0.2 |
| Part 8 | 0.40 | 0.3 | <0.4 | 0.9 | 5.0 | 1.3 | 0.5 |
| Part 9 | 0.41 | 0.8 | 1.8 | 1.7 | 0.8 | 0.4 | 0.08 |
| Part 10 | 0.81 | 0.2 | <0.4 | 0.2 | 4.1 | 4.3 | 1.0 |

Advantageously, the part may be cylindrical in shape. In a variant, and by way of example, the part may be in the shape of a cone or of a rectangular parallelepiped.

In yet another aspect, the present invention provides a low alloy steel part comprising iron and carbon and suitable for being obtained by performing a method as described above.

By way of example, such a part may have the same ingredients present at the same contents by weight as for the above-described part.

BRIEF DESCRIPTION OF THE DRAWINGS

Other characteristics and advantages of the invention appear from the following description of particular implementations of the invention given as non-limiting examples and with reference to the accompanying drawings, in which.

DETAILED DESCRIPTION OF IMPLEMENTATIONS

Figure 1:
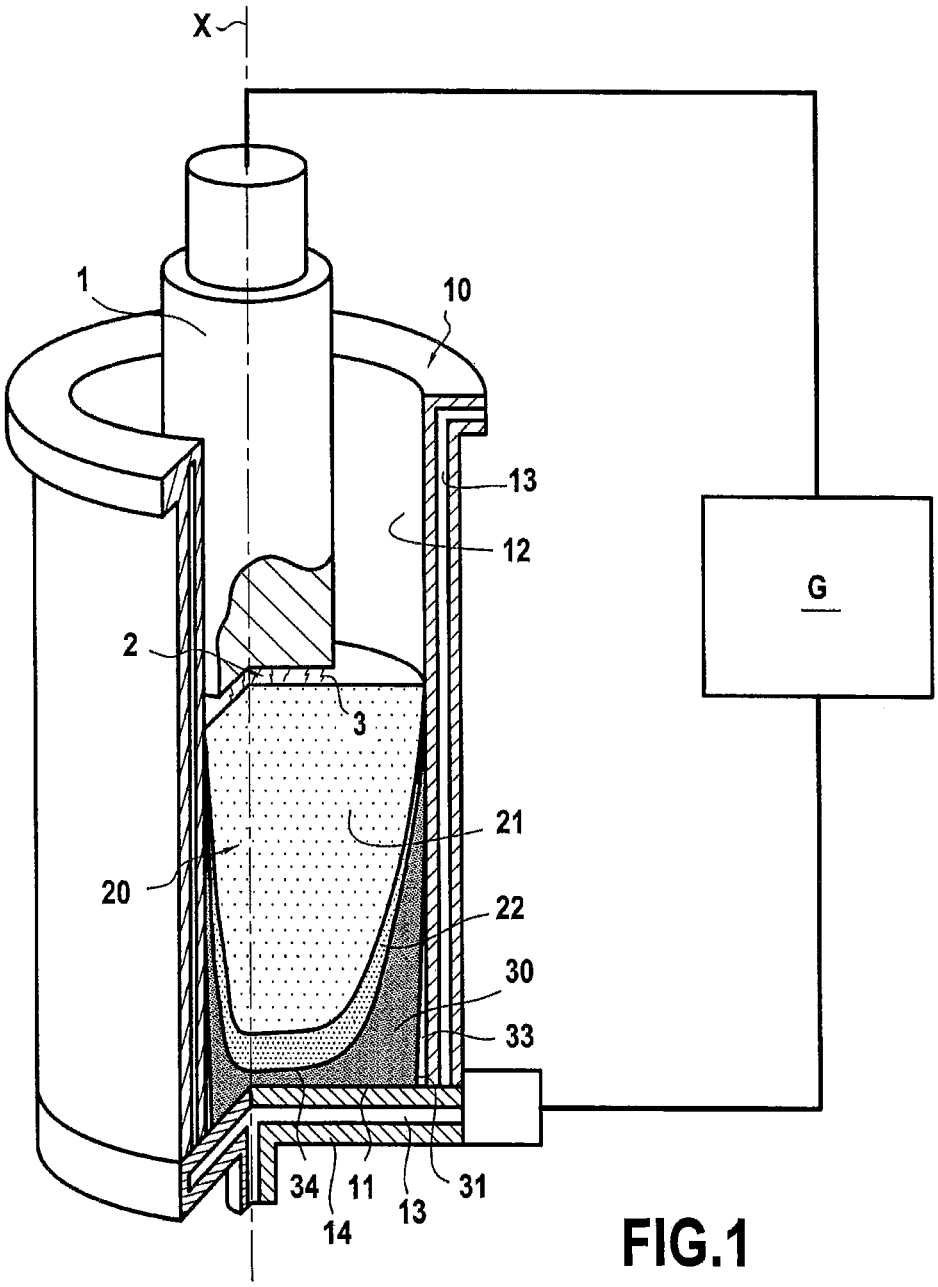
FIGS. 1 and 2 are diagrammatic and fragmentary views showing the implementation of a method of the invention.

As shown in FIG. 1, the electrode 1 that is to be melted is present in the inside volume defined by the crucible 10. The electrode 1 may previously have been prepared by any conventional means, such as preparation in air or preparation by induction in a vacuum. As shown, before being melted, the electrode 1 may be cylindrical in shape. As explained above, it would not go beyond the ambit of the present invention if an electrode were used that presents some other shape before melting.

By way of example, the crucible 10 is made of copper. The crucible 10 extends along a longitudinal axis X. A generator G imposes a potential difference between the crucible 10 and the electrode 1. As shown, a first terminal of the generator G may be connected to the electrode 1 and a second terminal of the generator G may be connected to the bottom 11 of the crucible 10, as shown. The potential difference imposed between the crucible 10 and the electrode 1 by the generator G serves to create electric arcs 3 in the gap 2 in which there exists a vacuum. These electric arcs 3 serve to melt the electrode 1 and to perform step a).

The melted portion of the electrode 1 is collected in the crucible 10 and thus forms a melt pool 20. The melt pool 20 has a liquid portion 21 situated beside the electrode 1 and a pasty portion 22 situated between the liquid portion 21 and the ingot 30. The ingot 30 is obtained by cooling the melted portion of the electrode. The solidification front 34 lies between the resulting ingot 30 and the melt pool 20, and during step b) it propagates towards the free surface of the melt pool 20. Water flows around the crucible 10 so as to cool the crucible 10 continuously and also cool the melt pool 20 so as to ensure that it solidifies.

In addition, as shown in FIG. 1, a cooling channel 13 is present within the side wall 12 of the bottom wall 14 of the crucible 10. A cooling liquid may flow within the cooling channel 13 in order to contribute likewise to solidifying the melt pool 20.

As shown, during step b), the ingot 30 is present between the melt pool 20 and the bottom 11 of the crucible 10 and also between the melt pool 20 and the side wall 12 of the crucible 10. In addition, at least a fraction of the peripheral surface 31 of the ingot 30 need not be in contact with the side wall 12 of the crucible 10, being separated therefrom by a gap 33. In some circumstances, it is possible to inject a gas (e.g. He, Ar, $N_2$) into this gap 33 in order to improve cooling.

At the end of step b), the resulting ingot 30 may be cylindrical in shape.

Figure 2:
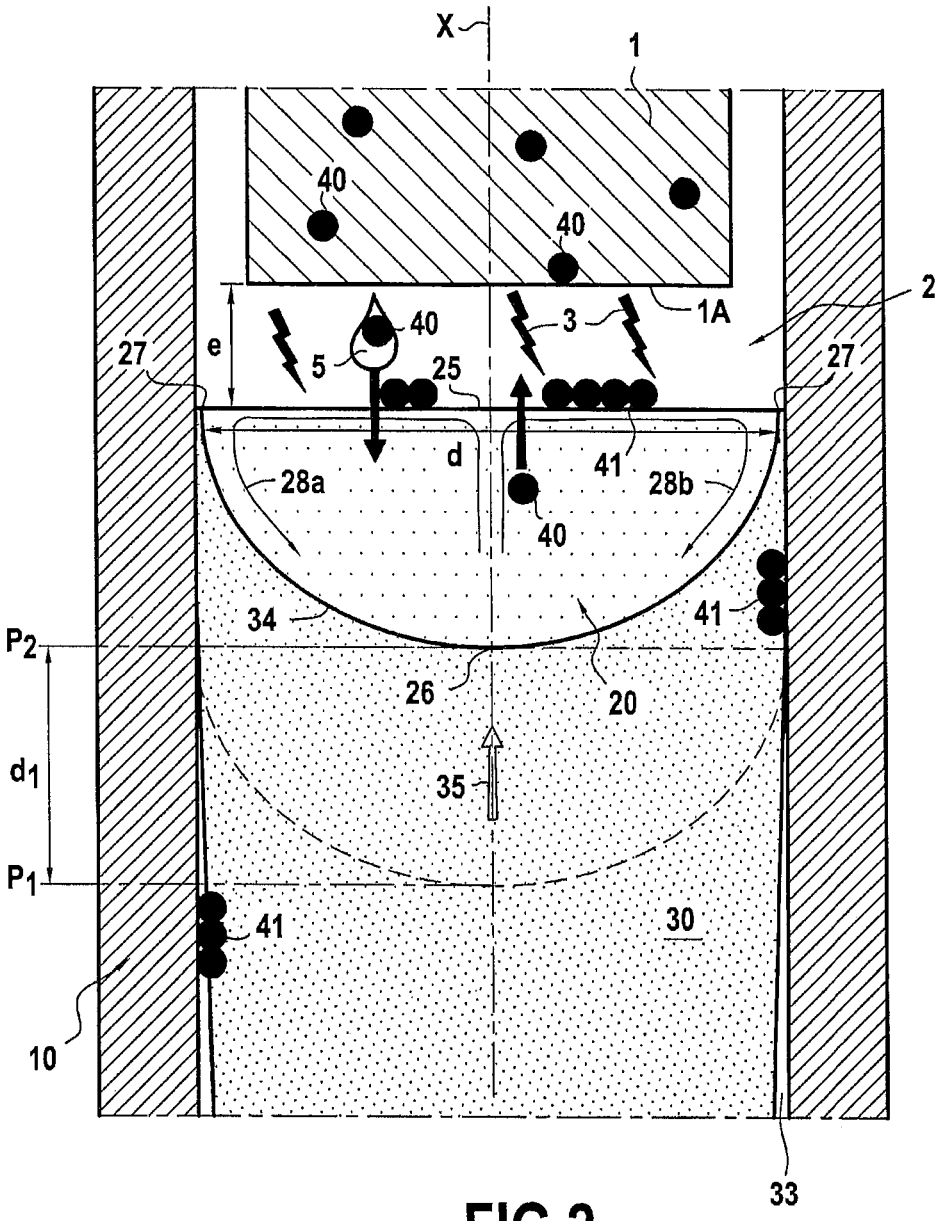

FIG. 2 is a simplified representation showing certain details of the method of the invention. Before melting, the electrode 1 includes inclusions 40. These inclusions 40 may be non-metallic inclusions. As shown, during melting, the end 1*a* of the electrode 1 is melted by the energy of the electric arcs 3. Drops 5 of melted electrode are produced, which are collected by the crucible 10. As explained above, the crucible 10 is cooled with water. The melt pool 20 has a diameter d equal to the inside diameter of the crucible 10.

As shown, throughout all or part of step b), the melt pool 20 may be hemispherical in shape. By way of example, such a shape may be obtained when the crucible 10 that is used is cylindrical in shape. The melt pool 20 may have other shapes, e.g. a semi-quasi-ovoid shape. Such a shape may be obtained for example when using a crucible of rectangular parallelepiped shape.

The distance e between the free surface 25 of the melt pool 20 and the electrode 1 is advantageously kept constant during step b). This distance e may be controlled either by controlling the voltage (V), or by controlling pulses associated with the drop rate of the drops 5. In the example shown, during step b), the electrode 1 is moved along the longitudinal axis X of the crucible 10 in order to keep the distance e constant.

During melting of the electrode 1, the drops 5 drop and they are collected by the crucible 10. The drops 5 may include inclusions 40 that were initially present in the electrode 1. Once the inclusions 40 have been taken to the melt pool 20, they may be entrained towards the bottom 26 of the melt pool 20 (i.e. the point of the melt pool 20 that is closest to the bottom 11 of the crucible and that is in contact with the solidification front 34).

From a thermal point of view, the melt pool 20 presents an axial portion of temperature that is greater than the temperature of its peripheral portion. This leads to natural convection, corresponding to the buoyancy forces that are engaged going from the bottom 26 of the melt pool 20 to the free surface 25 of the melt pool 20 and then going towards the edge 27 of the melt pool 20. This convection is represented in FIG. 2 by arrows 28*a* and 28*b*.

During remelting, solid or liquid inclusions 40 of density lower than the density of the melt pool 20 will tend to rise to the surface 25 at a certain speed as a result of buoyancy mechanisms, as explained above.

Aggregates 41 made up of agglomerated inclusions 40 are present on the free surface 25 of the melt pool 20. These aggregates 41 are entrained towards the periphery of the ingot 30, where they become frozen.

In FIG. 2, there can be seen the solidification front 34 propagating from the bottom 11 of the crucible 10 towards the free surface 25 of the melt pool. The solidification front 34 propagates during step b) along the longitudinal axis X of the crucible 10 as represented by arrow 35. As shown, the solidification front 34 may retain its shape throughout all or part of step b). The mean speed at which the solidification front 34 rises is controlled so as to be less than the speed at which all or some of the inclusions 40 rise to the surface, as explained above. Specific positions $P_1$ and $P_2$ occupied by the bottom 26 of the melt pool 20 are shown in FIG. 2. The distance $d_1$ traveled by the bottom 26 of the melt pool is measured along the longitudinal axis X of the crucible 10.

EXAMPLES

Example 1

An electrode having the following chemical composition: C 0.42%-Mn 0.82%-Ni 1.80%-Si 1.70%-Cr 0.80%-Mo 0.40%-V 0.08% and the balance Fe (the percentages are weight percentages) was melted by a vacuum arc remelting method.

Before melting, the diameter of the electrode was 920 mm.

The conditions applied during vacuum arc remelting were as follows:

applied voltage: 25 volts (V);

applied current: 9 kiloamps (kA); and pulses: 250 circuit-cutout drops of molten electrode produced per minute.

Those conditions enable a molten electrode drop rate to be obtained that was equal to 9.5 kilograms per minute (kg/min).

The molten electrode drops were collected in a crucible having a diameter of 975 mm and they formed a melt pool within the crucible that was made of copper.

Thereafter, the melt pool was solidified by exchanging heat between the melt pool and water flowing at a rate of 3000 L/min at a thermostatically-controlled temperature of 38° C. at the inlet and with continuous injection of He at 20 millibars (mbar).

The resulting heat exchange enabled a mean solidification speed of 24 μm/s to be imposed during step b).

After solidification, a low alloy steel ingot was obtained having the following chemical composition: C 0.410-Mn 0.800-Ni 1.800-Si 1.700-Cr 0.800-Mo 0.400-V 0.080, with the balance being Fe (the percentages are by weight).

The results obtained in terms of inclusion cleanliness using method D of the ASTM E 45-10 standard are given below in terms of number of fields along the longitudinal axis:

| Severity level | Size | A | B | C | D |
|---|---|---|---|---|---|
| 0.5 | Thin | 0 | 0 | 0 | 3 |
| 0.5 | Heavy | 0 | 0 | 0 | 1 |
| 1 | Thin | 0 | 0 | 0 | 0 |
| 1 | Heavy | 0 | 0 | 0 | 0 |
| 1.5 | Thin | 0 | 0 | 0 | 0 |
| 1.5 | Heavy | 0 | 0 | 0 | 0 |

The sum of the fields including type D inclusions in all three directions was 7.

Example 2 (Comparative)

An electrode having the following chemical composition: C 0.420-Mn 0.830-Ni 1.810-Si 1.720-Cr 0.850-Mo 0.380-V 0.09% and the balance Fe (the percentages are weight percentages) was melted by a vacuum arc remelting method.

Before melting, the diameter of the electrode was 550 mm.

The conditions applied during vacuum arc remelting were as follows:

applied voltage: 25 V;

applied current: 11 kA; and pulses: 330 circuit-cutout drops of molten electrode produced per minute.

Those conditions enable a molten electrode drop rate to be obtained that was equal to 12 kg/min±0.6 kg/min.

The molten electrode drops were collected in a crucible having a diameter of 600 mm and they formed a melt pool within the crucible that was made of copper.

Thereafter, the melt pool was solidified by exchanging heat between the melt pool and water flowing at a rate of 1500 L/min at a thermostatically-controlled temperature of 38° C. at the inlet and without injecting gas.

The resulting heat exchange enabled a mean solidification speed of 49 μm/s to be imposed during step b).

After solidification, a low alloy steel ingot was obtained having the following chemical composition: C 0.41%-Mn 0.81%-Ni 1.82%-Si 1.73%-Cr 0.85%-Mo 0.38%-V 0.09%, with the balance being Fe (the percentages are by weight).

The results obtained in terms of inclusion cleanliness using method D of the ASTM E 45-10 standard are given below in terms of number of fields along the longitudinal axis:

| Severity level | Size | A | B | C | D |
|---|---|---|---|---|---|
| 0.5 | Thin | 0 | 5 | 0 | 28 |
| 0.5 | Heavy | 0 | 1 | 0 | 15 |
| 1 | Thin | 0 | 1 | 0 | 2 |
| 1 | Heavy | 0 | 0 | 0 | 0 |
| 1.5 | Thin | 0 | 0 | 0 | 0 |
| 1.5 | Heavy | 0 | 0 | 0 | 0 |

The sum of the fields including inclusions of type B or type D in all three directions was 87. Such an ingot presents mechanical properties that are significantly lower than those of the ingot of the invention.

The term "including/comprising a" should be understood as "including/comprising at least one".

The term "in the range . . . to . . . " should be understood as including the limits.

The invention claimed is:

1. A part made of low alloy steel comprising iron and carbon, the part extending along a longitudinal axis, the part being such that when evaluated using the D method of the ASTM E 45-10 standard, the following results are obtained for analysis along the longitudinal axis:

the number of fields including type D inclusions of severity level equal to 0.5 is less than 5;

no field including type D inclusions of severity level equal to 1 is obtained; and no field including type B inclusions of severity level equal to 0.5 is obtained, wherein the part is fabricated by solidifying a melt pool comprising iron and carbon such that a mean solidification speed of the melt pool is less than or equal to 45 micrometers per second.

2. A part according to claim 1, wherein when the part is evaluated using the method D of the ASTM E 45-10 standard, the following result is obtained when summing three measurement results obtained along the longitudinal axis of the part and along two axes perpendicular to the longitudinal axis:

the total number of fields including type D inclusions of severity level equal to 0.5 is less than or equal to 15.

3. A part according to claim 1, wherein carbon is present at a content by weight lying in the range 0.09% to 1.00%.

4. A part according to claim 1, further comprising chromium at a content by weight lying in the range 0.05% to 5.00%.

5. A part according to claim 1, further comprising molybdenum at a content by weight less than or equal to 5.00%.

6. A part according to claim 1, comprising iron together with:

carbon at a content by weight lying in the range 0.09% to 1.00%;

manganese at a content by weight less than or equal to 5.00%;

nickel at a content by weight less than or equal to 5.00%;

silicon at a content by weight less than or equal to 3.00%;

chromium at a content by weight lying in the range 0.05% to 5.00%;

molybdenum at a content by weight less than or equal to 5.00%; and vanadium at a content by weight less than or equal to 5.00%.

* * * * *